US005203477A

United States Patent [19]

Lo

[11] Patent Number: 5,203,477

[45] Date of Patent: Apr. 20, 1993

[54] CLOSURE UNIT FOR KEGS

[75] Inventor: Sin W. Lo, Selangor Darul Ehsan, Malaysia

[73] Assignee: Yin Seng Lim, Selangor Darul Ehsan, Malaysia

[21] Appl. No.: 721,343

[22] Filed: Jul. 1, 1991

[30] Foreign Application Priority Data

Jun. 30, 1990 [MY] Malaysia ..... PI 9001116

[51] Int. Cl.[5] ..... B67B 5/00

[52] U.S. Cl. ..... 222/153; 222/400.7; 222/542; 137/212; 137/384; 141/302; 285/80; 285/924

[58] Field of Search ..... 222/153, 400.7, 542, 222/545; 137/212, 384; 277/227, 181, 189, 235 R; 141/302; 285/3, 924, 80, 82, 92

[56] References Cited

U.S. PATENT DOCUMENTS

| | | | |
|---|---|---|---|
| 3,306,622 | 2/1967 | Liebig | 277/235 X |
| 3,917,373 | 11/1975 | Peterson | 285/82 X |
| 4,102,465 | 7/1978 | Zahid | 277/235 R |
| 4,142,658 | 3/1979 | Golding . | |
| 4,351,456 | 9/1982 | Nezworski | 137/212 X |
| 4,715,414 | 12/1987 | Harrison et al. | 137/212 X |
| 4,977,936 | 12/1990 | Thompson | 277/181 X |

*Primary Examiner*—Gregory L. Huson

*Attorney, Agent, or Firm*—Jacobson, Price, Holman & Stern

[57] ABSTRACT

The invention relates to a closure unit for a container suited to filling and dispensing a beverage stored under a pressuring gas. The closure unit comprises a bush from which is disposed a tubular element mounting two concentric valves and a siphon tube which extends into the container. The bush is locked into place in the neck of the container by a threaded locking sleeve which sandwiches a deformable ring between it and the bush. The ring and locking sleeve have respective intermeshing saw toothed profiles which allow locking to occur. This prohibits gas flow from the container between the neck and the bush. Upon unlocking, the profile in the ring becomes fractured thereby depressuring the container. The concentric valves are defined by a tubular element which is surrounded by a resilient material which forms a gas seal for the outer of the valves, and which embeds a radially outward extending flange of the tubular element with the resilient material passing through apertures in the flange to form a continuous mass.

7 Claims, 2 Drawing Sheets

CLOSURE UNIT FOR KEGS

TECHNICAL FIELD

This invention relates to a valved closure unit for use with containers commonly known as kegs or casks. These containers are used to store beverages under the pressure of gas, with the beverages typically being such as beer, wine, soft drink, and the like. The valved closure unit acts to regulate the flow of beverage from the container whilst maintaining the contents under the necessary pressure to avoid the beverage going 'flat' through leakage of the pressurising gas and introducing outside air.

BACKGROUND ART

It is a commonly known arrangement to provide a pressurised container or keg with a tubular neck-like socket (often called a Barnes neck), which is welded to the container. Valved closure units engage these sockets, and are arranged to seal and control the entry of carbon dioxide or other gas as a pressurising agent into the container, and the exit of beer or carbonated soft drinks via a separate dispense head. The closure units also permit the entry and exit of cleaning liquid and/or steam during the washing process of the container.

A typical closure unit for such a socket includes a bush which is received in the tubular neck and permits the filling, dispensing or retention of beer or carbonated soft drinks. The bush is made as a one-piece unit from metals such as stainless steel, aluminium, brass, etc., and is usually externally threaded at the upper end to engage a like-thread of the neck; the bush forms a valve seat at the other end.

A tubular member (retainer) is located below and supported by the valve seat. This tubular member houses two concentric valves, one being a gas valve and the other a beverage valve which are separately spring-loaded and act in association with a siphon tube, which extends into the container, and typically to near the bottom of the container to regulate the flow of the pressurising agent and beverage. A typical example of such is shown in U.S. Pat. No. 4,142,658 assigned to GKN Sankey Limited.

This known arrangement is generally satisfactory, however there are a number of disadvantages, and specifically that:

i) If the closure unit is to be removed and the bush is not unscrewed from the neck carefully it will eject with great force, and this action is potentially dangerous to a person servicing the container.

ii) Unauthorised removal or loosening of the valved closure unit may cause contamination of the beer or soft drink due to entry of micro-organisms; that is, the known closure units are not tamper-proof.

iii) The gas valve is a metal piece, tubular in shape having a radially outward extending flange on the upper end, and on which flange a mass of resilient material is applied to form a seal with the bush. During cleaning the entire valved closure unit is exposed to the action of pressurised washing liquid, and to heat from steam. Experience has shown that the gas valve needs to be replaced frequently due to damage which is caused by such cleaning procedure. That is, during cleaning the resilient material is hardened by steam and possible reaction to the washing liquid, and the contact of pressurised steam can cause the material to break, weaken, peel or dislodge, thereby resulting in the closure unit leaking and become non-functionable in subsequent use.

OBJECT AND STATEMENT OF THE INVENTION

It is therefore an object of the invention to overcome one or more of the disadvantages in the prior art.

Therefore, the invention in one aspect, provides a closure unit for a container, the container having an upstanding neck fixedly attached to the perimeter of an opening in the container and the neck being internally threaded at the upper end, the closure unit comprising:

a bush for receipt in and support by the neck, the bush supporting valve means providing for the passage of beverage and pressurising gas to the container, a deformable ring mounting atop the bush; and a locking sleeve having external threading to engage the threading of the neck to lock the bush into the neck and thereby deforming the said ring interposed between the locking sleeve and the bush to prevent leakage of pressurising gas from the container between the bush and the neck.

It is preferable that the bush has a plurality of slots on its upper surface which receive legs extending downwardly from the said ring to fix the ring to the bush, and further that the ring has a profiled upper surface which can interact with a like-profiled lower surface on the locking sleeve, and arranged such that, in use, the locking sleeve can be tightened against the ring when screwed into the neck, but on unscrewing will fracture the ring so as to allow the gradual release the pressuring or gas from within the container.

The invention also provides a closure unit for a container, the container having an upstanding neck fixedly attached to the perimeter of an opening in the container and the neck being internally threaded at the upper end, the closure unit comprising:

a bush for receipt in and support by the neck, the bush forming a valve seat which seats two concentric valves which are retained by spring means against the valve seat, and wherein the concentric valves are delineated by an annular element, the annular element having an outwardly radiused flanged end with spaced apertures in said flanged end, and resilient material enveloping said flanged end and passing through the said apertures to form a continuous mass, with the resilient means sealing the outer one of the concentric valves against the valve seat.

BRIEF DESCRIPTION OF DRAWINGS

In order that the invention can be more clearly explained, examples of preferred embodiments will now be described with reference to the accompanying drawings in which.

DESCRIPTION OF PREFERRED EMBODIMENTS

Figure 1:
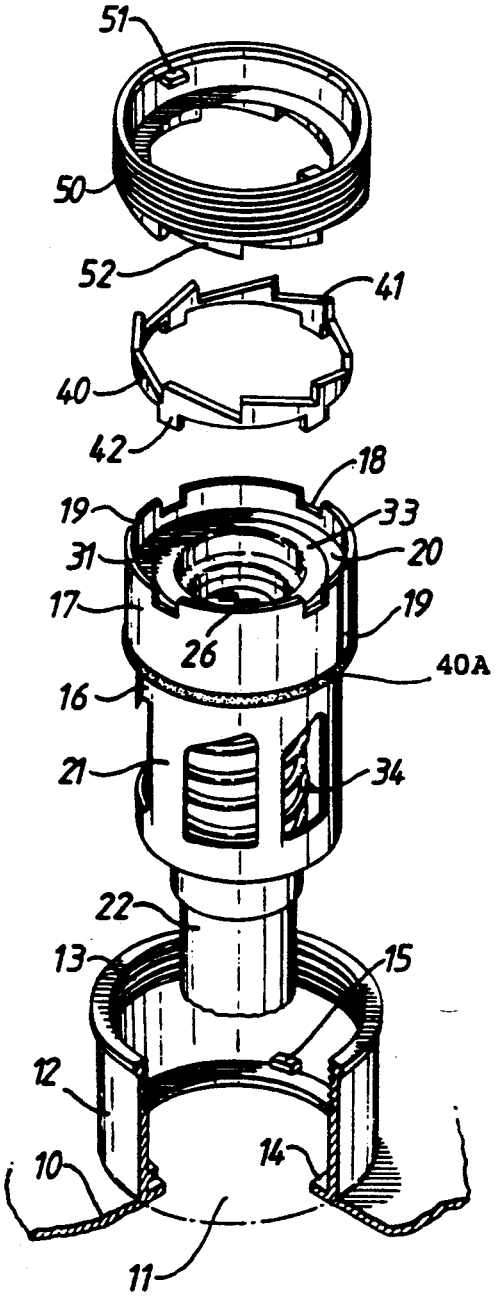
FIG. 1 is a partly cut away and exploded perspective view of the neck of a keg, and a closure unit constructed in accordance with the invention.
Figure 2:
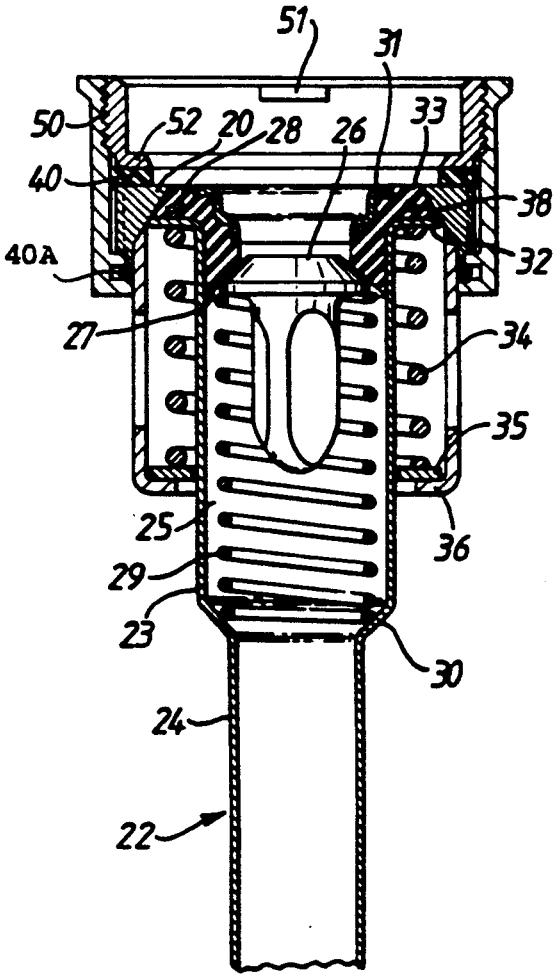
FIG. 2 is a vertical section of the closure unit engaged with the keg neck.

Referring to FIGS. 1 and 2, examples of embodiments of the invention are shown in the context of a keg top wall 10 which has a bung hole 11 and a neck 12 circumferentially welded to the edge of the hole 11. The neck 12 is internally threaded near its upper end 13. At its lower end the neck 12 has a radially inward extending flange 14 and radially inward extending spaced locking lugs 15.

A subassembly 16 includes a bush 17 which has four equally spaced radial slots 18 on its upper rim, and two longitudinal slots 19 on the outer wall. When the bush 17 is received in the neck 12, the bottom edge of the bush 17 sits on a gasket indicated by 40A and is supported on the neck flange 14, and the longitudinal slots 19 cooperate with the lugs 15 to prevent the bush 17 from rotating. The bush 17 is bored to form a valve seat 10 at its underside.

The subassembly 16 further includes a tubular member 21 which is firmly fixed beneath the valve seat 20 (typically by welding) and houses a siphon tube 22, which also extends therefrom. The valve seat 20 seats two concentric valves. The upper portion 23 of tube 22 is larger in diameter than the lower portion 24, the upper portion 23 is provided with a radially outward extending flange 32 engaging the bush 17. The upper portion 23 defines the outer wall of a chamber 25, in which is received a coiled compression spring 29 which engages with a shoulder 30 formed between the upper portion 23 and the lower portion 24 of the siphon tube 22. A beverage valve 26 is mounted atop of the spring 29 and is urged upwardly to engage a seat 27 on a gas valve 28.

The gas valve 28 includes a tubular element, preferably of metal, having radially outward extending flange 31 on its upper end. The tubular element is reinforced with a mass of resilient material 38 surrounding its external wall. The flange 31 is embedded in the resilient material 38. The top of the resilient material 38 forms a sealing flange 33, which sealing flange 33 seats on the valve seat 20 to shut off the top end of the upper portion 23 of the tube 22 so as to prevent the passage within the container through the inner wall of the tubular member 21. The resilient material 38 also serves as a gas valve seat 27 which in turn engages a beverage valve 26 so as to prevent leaking of beverage from within the chamber 25 (FIG. 2). The sealing flange 33 is fixedly supported to the flange 32 of the siphon tube 22.

A coiled compression spring 34 surrounds the outer wall of chamber 25 and engages the flange 32 at one end and a washer 35 which rests on the radially inward extending lugs 36 at the lower end of tubular member 21 to urge the siphon tube 22 upwards thereby to close passage for the gas into the chamber formed between the tubular member 21 and the upper portion 23 of the siphon tube 22 by the resilient material 38 engaging the valve seat 20. The washer 35 has openings which allow the passage of the pressurising gas to be in communication with the gas valve 28. The passage of gas past the gas valve 28 can only be achieved if the upwardly directed force of the spring 34 can be overcome such as in charging a container.

Figure 3:
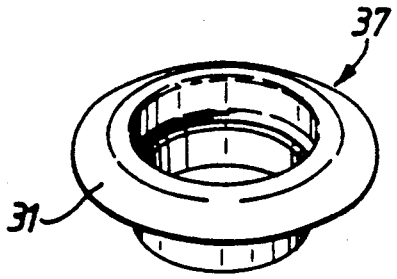
Fig.3 (PRIOR ART)
FIG. 3 is a perspective view of a tubular element for a gas valve of the prior art.
Figure 4:
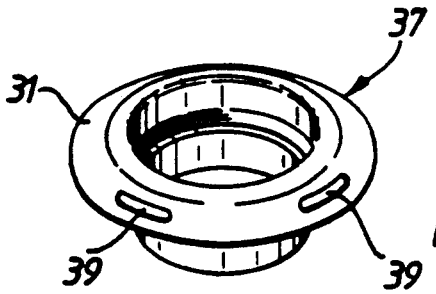
FIG. 4 is a perspective view of the tubular element for a gas valve constructed in accordance with the invention.

FIG. 3 shows a known tubular element for a gas valve. In comparison, FIG. 4 shows a tubular element 37 of the present embodiment. This element 37 has spaced apertures, holes or slots 39 formed in the radially outward extending flange 31. In this way when the resilient material 38 is applied in the formation of the gas valve 28 it can pass through the holes 39 so as to create a continuous mass in which the flange is embedded. This provides particular advantages, in that problems of the resilient material 38 peeling way or dislodging, particularly when being cleaned, is avoided, hence the gas valve 28 has a longer service life being less prone to leaks or failure.

Figure 5:
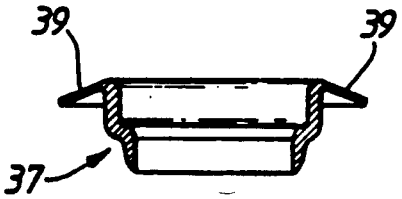
FIG. 5 is a vertical view of the tubular element of FIG. 4.
Figure 6:
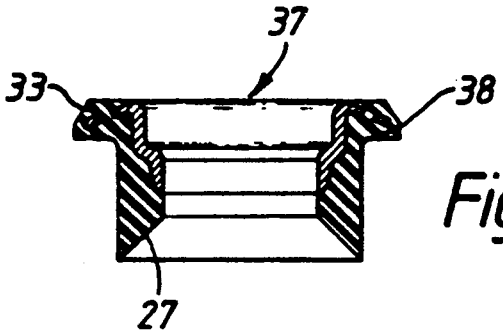
FIG. 6 is a vertical view of the tubular element of FIG. 4 with the resilient material applied.

FIG. 5 shown the tubular element in section, while FIG. 6 is a similar view with the resilient material formed about the tubular element 37 and passing through the holes.

As previously discussed, when the subassembly unit 16 is received in the neck 12, the bush 17 is supported by the neck flange 14, the tubular member 21, which houses the valves and spring, and the siphon tube 22 are insertable past the neck flange 14, and the lower end of the siphon tube extends near to the bottom of the keg. The subassembly 16 must then be locked into place.

FIG. 1 shows a locking sleeve 50 and a deformable ring 40 which achieve the locking function. The ring 40 is constructed of deformable material, typically low density polyethylene, silicone or rubber, and is provided with four legs 42 which project downardly to engage the slots 18 in the bush 17, thereby to hold the ring 40 in place. The upper edge of the ring 40 has a saw toothed profile 41. This is not the only profile which can be successfully used.

The metal locking sleeve 50 is externally threaded so as to engage the internal thread of the upper end 13 of the neck 12. The locking sleeve 50 is screwed into the neck by the agency of the radially inward extending lugs 51 which engage a tool (not shown) to lock or unlock the subassembly 16. The saw toothed profile 52 of the locking sleeve's lower edge is free to deform the saw toothed profile 41 of the ring 40 to allow rotation of the locking sleeve 50 only in the direction of locking (in this case being clockwise rotation). The ring 40 will also be compressed to extend outwards and provide a leak proof fit against the neck 12 in the region between the lugs 15 and threaded upper end 13. If the locking sleeve is rotated in the opposite unlocking direction (anticlockwise), the respective saw toothed profiles 41, 52 lock, which causes the ring 40 to fracture at the weak points (FIG. 1), so as to allow release of gas hence causing gradual decompression within the container. The released gas passes through the wall between the neck and the bush 17 and the fractured ring 40. By the time the locking sleeve is free of the thread on the neck there is no internal pressure to cause dangerous ejection of the subassembly 16. Another benefit of this arrangement is that it becomes clear whether a container and its contents have been tampered with in any way, since the ring 40 will be fractured and the pressurising gas have escaped leaving the contents flat.

Various modifications and alterations, as would be apparent to one skilled in the art, can be made without departing from the inventive concept as has been described herein and in the appended claims

I claim:

1. A closure unit for a container, the container having an upstanding neck fixedly attached to the perimeter of an opening in the container and the neck being internally threaded at the upper end, the closure unit comprising:

a bush for receipt in and support by the neck, the bush forming a valve seat which seats two concentric valves which are retained by spring means against the valve seat, and wherein the concentric valves are delineated by an annular element, the annular element having an outwardly radiused flanged end with spaced apertures in said flanged end, and resilient material enveloping said flanged end and passing through said apertures to form a continuous mass, with said resilient means sealing the outer one of said concentric valves against the valve seat;

a deformable ring mounting atop said bush;

a locking sleeve having external threading and when in use, said locking sleeve is tightened against said deformable ring when screwed into said neck of the container but on unscrewing will fracture said ring so as to allow release of pressuring gas within the container through the wall between said neck and said bush and said fractured ring such that most of the gas would have escaped before said locking sleeve is free of said neck.

2. A closure unit as claimed in claim 1, wherein said bush has a plurality of slots on its upper surface which receive legs extending downwardly from said ring to fix it to the bush.

3. A closure unit as claimed in claim 1, wherein the ring has a profiled upper surface which can interact with a like-profiled lower surface on the locking sleeve.

4. A closure unit as claimed in claim 3, wherein said profiled upper surface of the deformable ring and said profiled lower surface of the locking sleeve are of saw toothed and intermeshing profile.

5. A closure unit as claimed in claim 1, wherein the bush is provided with a plurality of vertical slots about its periphery, which in use, engage internal lugs in the neck to fix the bush against rotation.

6. A closure unit as claimed in claim 1, wherein the locking sleeve has two or more radially inward directed lugs which engage a tool to effect rotation of the locking sleeve in locking or unlocking operations.

7. A closure unit as claimed in claim 1, wherein the outer valve is a gas valve and the inner valve is a beverage valve.

* * * * *